US008063727B2

(12) United States Patent
Emmons et al.

(10) Patent No.: US 8,063,727 B2
(45) Date of Patent: Nov. 22, 2011

(54) CONDUCTIVE SHIELDING DEVICE

(75) Inventors: Thomas R. Emmons, St. Louis Park, MN (US); Kenneth G. Otto, Vadnais Heights, MN (US)

(73) Assignee: Teradyne, Inc., North Reading, MA (US)

( * ) Notice: Subject to any disclaimer, the term of this patent is extended or adjusted under 35 U.S.C. 154(b) by 1383 days.

(21) Appl. No.: 11/608,465

(22) Filed: Dec. 8, 2006

(65) Prior Publication Data

US 2008/0136576 A1 Jun. 12, 2008

(51) Int. Cl.
*H01F 27/32* (2006.01)

(52) U.S. Cl. ..... 336/84 C

(58) Field of Classification Search ..... 336/84 C, 336/84 R; 174/350–387
See application file for complete search history.

(56) References Cited

U.S. PATENT DOCUMENTS

| | | | | |
|---|---|---|---|---|
| 3,382,471 | A | 5/1968 | Brueckmann | |
| 3,461,413 | A | 8/1969 | Randolph et al. | |
| 4,801,912 | A | 1/1989 | McElheny et al. | |
| 5,166,655 | A | 11/1992 | Rogers | |
| 5,763,824 | A * | 6/1998 | King et al. | 174/374 |
| 6,229,124 | B1 | 5/2001 | Trucco | |
| 6,653,923 | B2 | 11/2003 | Li et al. | |
| 6,707,687 | B2 * | 3/2004 | Kogasaka et al. | 361/800 |
| 6,847,280 | B2 | 1/2005 | Kung | |
| 6,936,764 | B2 | 8/2005 | Groves et al. | |
| 7,049,682 | B1 | 5/2006 | Mathews et al. | |
| 7,076,230 | B2 | 7/2006 | Nakatsuji et al. | |
| 7,463,496 | B2 * | 12/2008 | Robinson et al. | 361/818 |
| 7,491,901 | B2 * | 2/2009 | Lu | 174/386 |
| 2004/0207503 | A1 | 10/2004 | Flanders et al. | |
| 2004/0222478 | A1 | 11/2004 | Zhang et al. | |
| 2005/0073382 | A1 | 4/2005 | Kung | |

OTHER PUBLICATIONS

International Search Report and Written Opinion of the International Searching Authority for application No. PCT/US 06/49301 dated Mar. 21, 2008.
International Preliminary Report on Patentability in Application No. PCT/US2006/049301, dated Jun. 10, 2009.

* cited by examiner

*Primary Examiner* — Tuyen Nguyen
(74) *Attorney, Agent, or Firm* — Fish & Richardson P.C.

(57) ABSTRACT

Devices and methods for reducing stray magnetic fields from an inductor are disclosed. In some aspects, a device includes a substantially U-shaped component configured to attach to a conductive surface of a printed circuit board and configured to substantially surround a lengthwise portion of an inductor on three sides of the inductor.

16 Claims, 7 Drawing Sheets

SIDE VIEW

Top View

Side View

Bottom View

Edge View

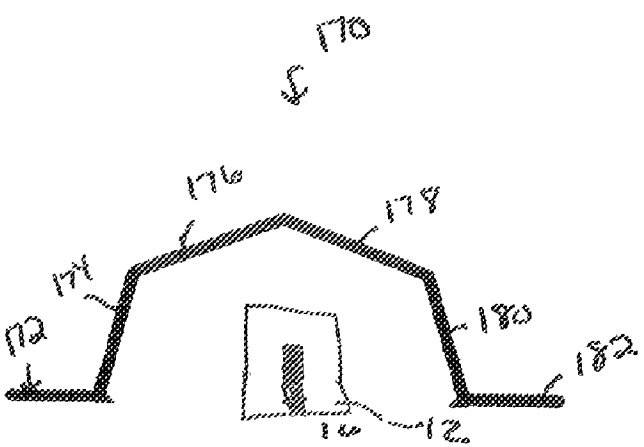
FIG. 9
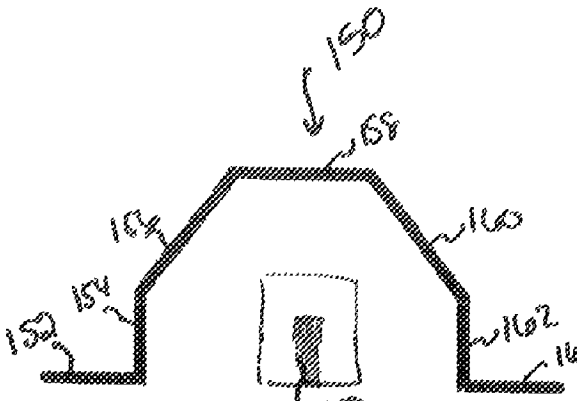
FIG. 8
FIG. 11
FIG. 10

CONDUCTIVE SHIELDING DEVICE

TECHNICAL FIELD

This patent application relates generally to a conductive shielding device for reducing stray magnetic fields from an inductor.

BACKGROUND

An inductor can be constructed as a copper wire with a core wrapped around it. The core can be formed of a ferromagnetic material and include an air gap. In operation, inductors generate a stray magnetic field. In some implementations, the inductor can be wrapped with a conductive band (e.g., a copper band) to reduce the stray magnetic field emitted from the inductor. Wrapping the inductor with a conductive band is one way to reduce the stray magnetic field from the inductor; however, it can have disadvantages. For example, it can be difficult to wrap the inductor with the conductive band.

SUMMARY

This patent application relates generally to a conductive shielding device for reducing stray magnetic fields from an inductor.

In general, in one aspect, the invention features a method that includes attaching an inductor to a printed circuit board. The method also includes attaching a U-shaped conductive shielding component to a conductive pad on the printed circuit board such that the conductive pad and the U-shaped conductive shielding component substantially surround a lengthwise portion of the inductor.

Embodiments can include one or more of the following.

Attaching the inductor to the printed circuit board can include attaching the inductor such that a gap of the inductor is located on a portion of the inductor located adjacent to the printed circuit board. The U-shaped conductive shielding component can have a first side substantially perpendicular to the printed circuit board, a second side substantially perpendicular to the printed circuit board and substantially parallel to the first side, and a third side connected to the first and second sides and substantially parallel to the printed circuit board. The method can also include forming the U-shaped conductive shielding component using a metal stamping process. Attaching the U-shaped conductive shielding component to the conductive pad on the printed circuit board can include soldering the U-shaped conductive shielding component to the conductive pad on the printed circuit board.

In general, in one aspect, the invention features a system for reducing stray magnetic fields from an inductor. The system includes a conductive shielding device. The conductive shielding device includes a first side, a second side substantially parallel to the first side, and a third side attached between the first and second side, the third side being substantially perpendicular to the first and the second sides.

Embodiments can include one or more of the following.

The first side of the conductive shielding device can be substantially perpendicular to a surface of a printed circuit board. The second side of the conductive shielding device can be substantially perpendicular to the surface of the printed circuit board. The third side of the conductive shielding device can be substantially parallel to the surface of the printed circuit board. The system can also include a printed circuit board. The printed circuit board can include a conductive pad on a surface of the printed circuit board. The conductive shielding device further can also include a first attachment portion extending at an angle from the first side and a second attachment portion extending at an angle from the second side. The first attachment portion and the second attachment portion can be in electrical communication with the conductive pad. The conductive shielding device can be a stamped metal component. The conductive shielding device can be formed of copper. The conductive shielding device can be formed of tin. The system can also include an inductor attached to the printed circuit board. The conductive pad, the first side of the conductive shielding device, the second side of the conductive shielding device; and the third side of the conductive shielding device can substantially surround a lengthwise portion of the inductor.

In general, in one aspect, the invention features a device for reducing stray magnetic fields from an inductor. The device includes a substantially U-shaped stamped metal component configured to attach to a conductive surface of the printed circuit board and configured to substantially surround a lengthwise portion of an inductor on three sides of the inductor.

The details of one or more examples are set forth in the accompanying drawings and the description below. Further features, aspects, and advantages of the invention will become apparent from the description, the drawings, and the claims.

DESCRIPTION OF THE DRAWINGS

FIGS. 8-16 show cross-sectional views of additional implementations of the shielding device.

Like reference numerals in different figures indicate like elements.

DETAILED DESCRIPTION

Figure 1:
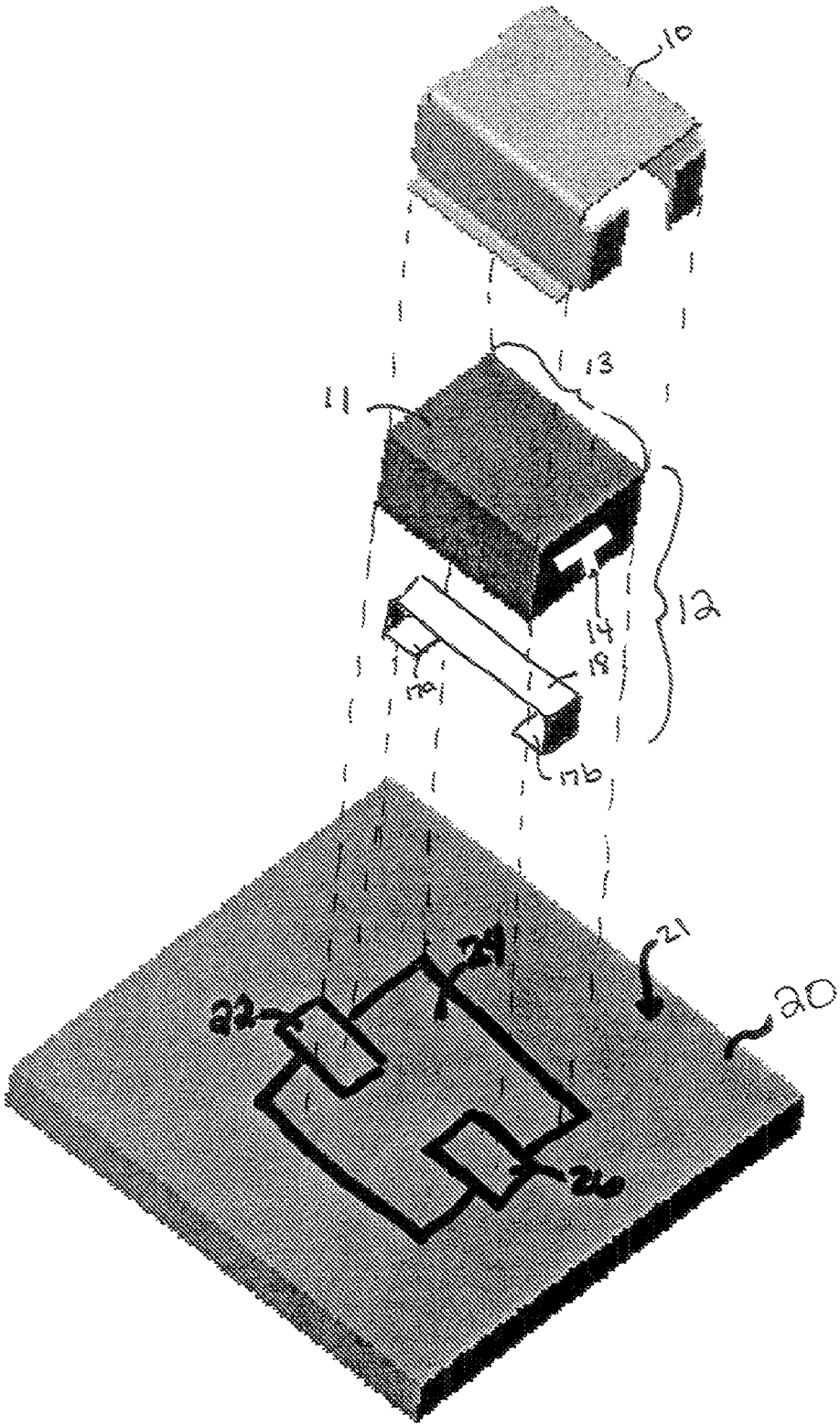
FIG. 1 is a diagram of a printed circuit board, an inductor, and a shield device with arrows indicating how they are interconnected.
Figure 2:
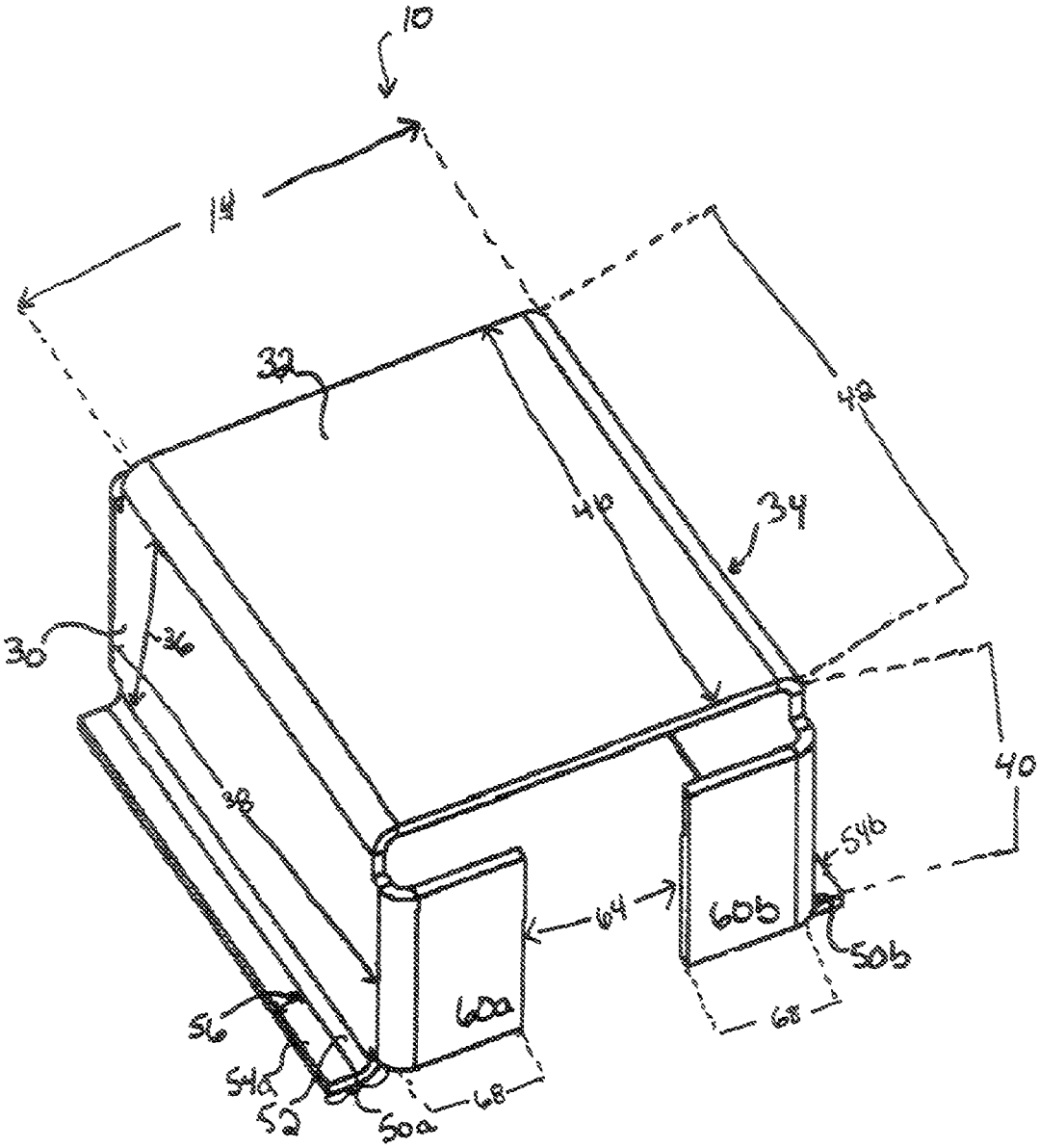
FIG. 2 is a perspective view of the shield device of FIG. 1.
Figure 3:
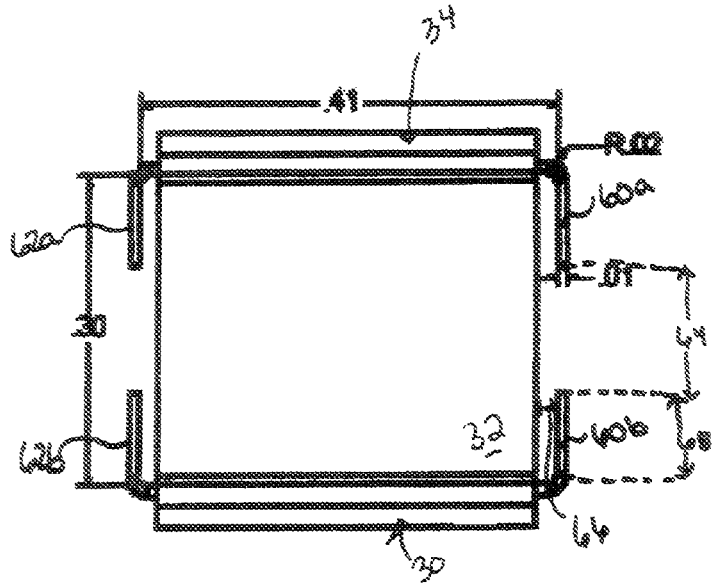
FIG. 3 is a top view of the shield device of FIG. 1.
Figure 4:
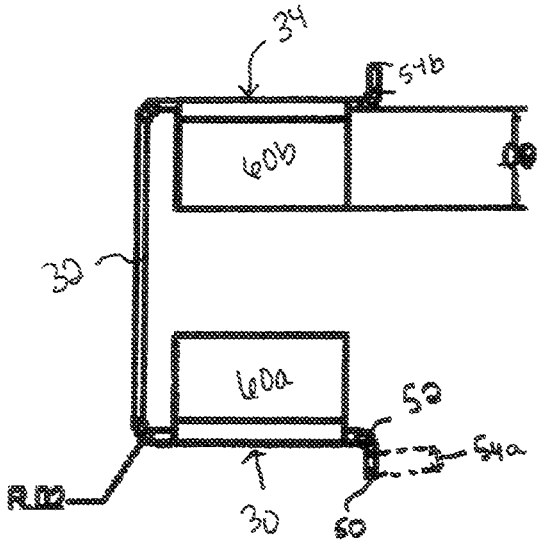
FIG. 4 is a side view of the shield device of FIG. 1.
Figure 5:
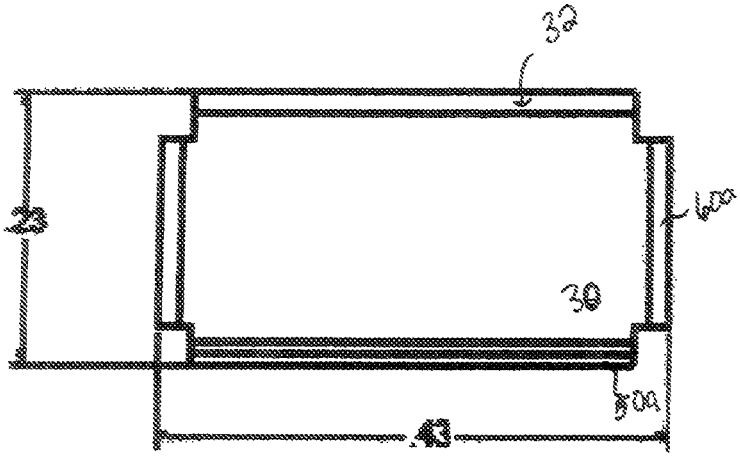
FIG. 5 is a side view of the shield device of FIG. 1.

FIG. 1 shows an expanded view of a device 10 for shielding an inductor (hereinafter a "shielding device" or a "conductive shielding component"), an inductor core 11, a lead wire 18, and a printed circuit board (PCB) 20. The lead wire 18 includes portions 17*a* and 17*b* that extend from the inductor core 12 and form an electrical contact with contact pads 22 and 26 on printed circuit board 20. Portions 17*a* and 17*b* can also physically secure the inductor 12 to the printed circuit board 20. The shielding device 10 is substantially U-shaped (e.g., has a substantially U-shaped portion). The shielding device 10 can be attached to the printed circuit board 20 such that the shielding device 10 substantially encloses a lengthwise portion (e.g., lengthwise portion 13) of the inductor 12 on three sides and a conductive surface 24 on the printed circuit board 20 substantially encloses a length-wise portion of the inductor 12 on a fourth side. When the shielding device 10 is attached to the conductive surface 24, the shielding device 10 and conductive surface 24 substantially surrounds a length-wise portion of the inductor 12. Since the combination of the conductive surface 24 and the shielding device 10 form a conductive cylinder around the length-wise portion of inductor 12, the stray magnetic fields from the inductor 12 can be reduced in comparison to an inductor without a shielding device.

In general, the shielding device 10 is formed of an electrically conductive material. Exemplary conductive materials include copper, tin and beryllium-copper.

The use of the conductive surface 24 and the shielding device 10 to shield stray magnetic fields from the inductor 12 can provide various advantages. For example, since the shielding device 10 is attached to the printed circuit board 20 to form a conductive perimeter around a portion of the inductor 12, the shielding device 10 can be applied using surface mount methods. In addition, since the shielding device 10 itself does not need to be a closed structure, the shielding device 10 can be easily made and assembled (e.g., as described below).

FIGS. 2-5 show a perspective view, a top view, and two side views of the shielding device 10, respectively. The shielding device 10 includes three sides 30, 32, and 34 which, when attached to the conductive surface 24 of the printed circuit board 20, form a U-shaped structure that can surround a length-wise portion of the inductor 12. Sides 30 and 34 may be substantially parallel to one another and side 32 connected sides 30 and 34 and may be substantially perpendicular to sides 30 and 34. Thus, when located on the printed circuit board 20, sides 30 and 34 may be substantially perpendicular to a surface 21 of the printed circuit board 20 and side 32 may be substantially perpendicular to the surface 21 of the printed circuit board 20.

Side 30 of shielding device 10 can be of a height 36 and length 38. Side 34 of shielding device 10 can be of a height 40 and length 42. In one implementation of shielding device 10, heights 36 and 40 and lengths 38 and 42 may be substantially the same. In another implementation, heights 36 and 40 and lengths 38 and 42 of the shielding device 10 may be different. In one implementation, in order to accommodate the inductor 12, heights 36 and 40 and lengths 38 and 42 are such that the inductor 12 can fit within the shielding device 10. For example, heights 36 and 40 can be from about 0.1 inch to about 1 inch and lengths 38 and 42 can be from about 0.2 inches to about 2 inches.

Side 32 of shielding device 10 can be a width 44 and length 46. In one implementation of shielding device 10, lengths 38, 42, and 46 of the shielding device 10 may be substantially the same. In some implementations, in order to accommodate the length and width inductor 12, width 44 and length 46 are such that the inductor can fit within the shielding device 10. For example, width 44 can be from about 0.2 inches to about 2 inches and length 46 can be from about 0.2 inches to about 2 inches.

Shielding device 10 includes a pair of attachment portions 50*a* and 50*b*. The attachment portions 50*a* and 50*b* extend from sides 30 and 34, respectively, and are used to attach the shielding device 10 to the conductive surface 24 of the printed circuit board 20. The attachment portions 50*a* and 50*b* include regions 54*a* and 54*b*, respectively, that may be approximately perpendicular to sides 30 and 34. Thus, when located on a printed circuit board, the attachment portions 50*a* and 50*b* may be substantially parallel to the printed circuit board 20 forming both a mechanical and an electrical connection between the shielding device 10 and the conductive surface 24 of the printed circuit board 20. For example, the attachment portions 50*a* and 50*b* can be connected to the conductive surface 24 of the printed circuit board 20 using a conductive adhesive (e.g., solder). Regions 54*a* and 54*b* can be of a width 56. In one implementation of shielding device 10, in order to facilitate attachment of the shielding device 10 to the printed circuit board 20, the width 56 is such that the width 56 can cover a conductive adhesive.

Shielding device 10 also includes two pairs of end tabs (e.g., end tabs 60*a* and 60*b* and end tabs 62*a* and 62*b*). End tabs 60*a* and 62*a* extend at an angle from side 30 toward side 34. In some implementations, the end tabs 60*a* and 62*a* are substantially perpendicular to side 30. Similarly, end tabs 60*b* and 62*b* extend at an angle from side 34 toward side 30. In some implementations, the end tabs 60*a* and 62*b* are substantially perpendicular to side 34.

End tabs 60*a*, 60*b*, 62*a*, and 62*b* can be of a length 68. In one implementation of shielding device 10, length 68 is selected such that a gap 64 is present between the end tabs 60*a* and 60*b* and between end tabs 62*a* and 62*b*. In some implementations, the width of the gap 64 can be selected such that a portion of the lead wire 18 that extends from the core 11 of the inductor 12 can fit between the end tabs 60*a*, 60*b*, 62*a*, and 62*b* without contacting the end tabs 60*a*, 60*b*, 62*a*, and 62*b*.

Figure 6:
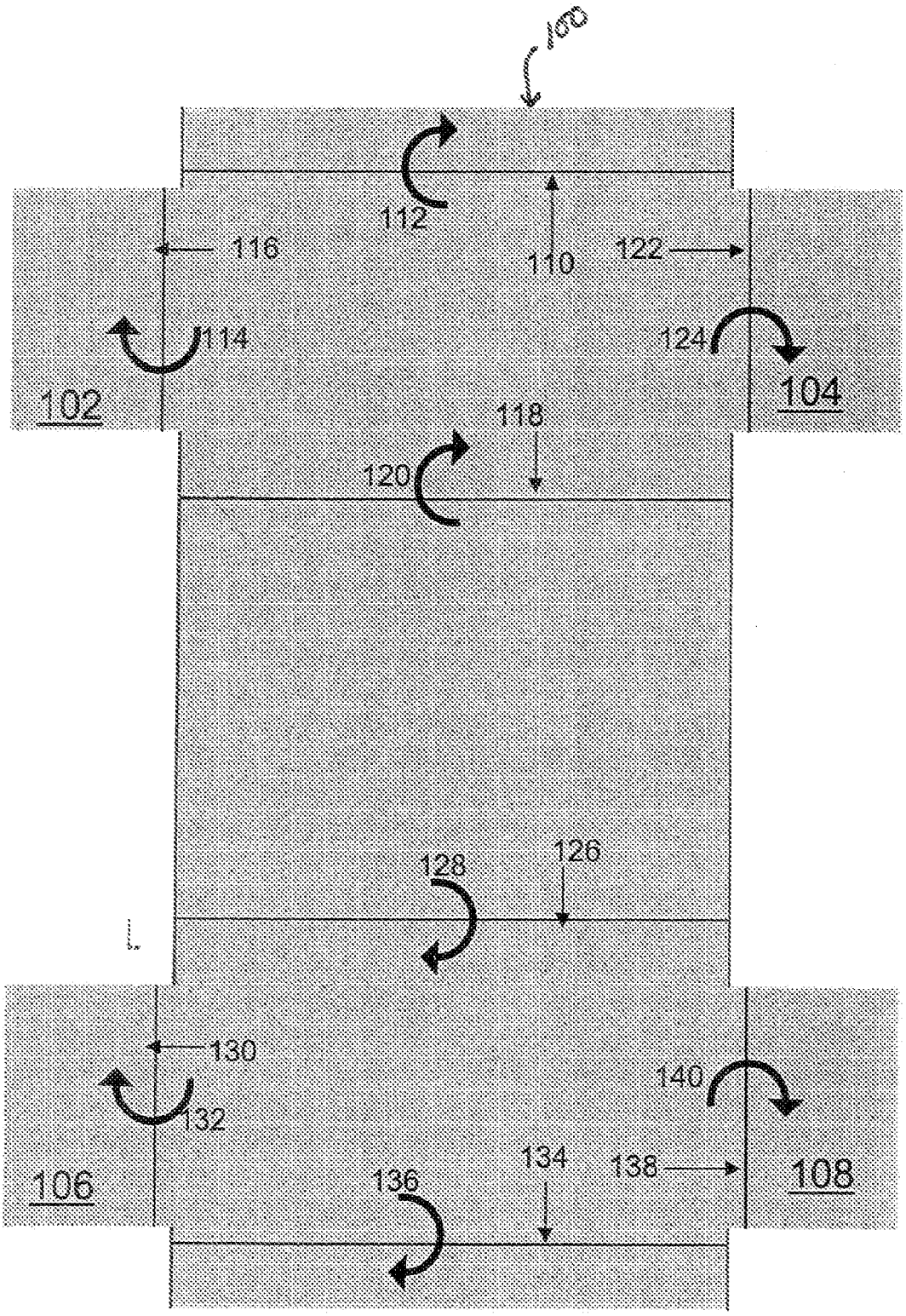
FIG. 6 is a diagram of the metal pattern for the shield device of FIG. 1.

It is believed that shielding device 10 can provide the advantage of being easily manufactured. Since the shielding device 10 does not need to be a closed structure (e.g., because the fourth electrically conductive side is provided by the conductive surface 24 of the printed circuit board 20), the shielding device can be stamped from a sheet of conductive material. For example, as shown in FIG. 6, a single piece of conductive material can be bent to form shielding device 10. The piece of conductive material is cut to form a rectangular portion 100 with four smaller rectangular portions 102, 104, 106, and 108 extending from the rectangular portion 100.

Lines 110, 116, 118, 122, 126, 130, 134, and 138 indicate locations at which the single piece of conductive material is bent to form the shielding device 10. More particularly, the top surface 32 is formed by bending the piece of conductive material along lines 118 and 126 (as indicated by arrows 120 and 128). The sides 30 and 34 and attachment portions 50*a* and 50*b* are formed by bending the piece of conductive material along lines 134 and 110 (as indicated by arrows 112 and 136). The end tabs 60*a*, 60*b*, 62*a*, and 62*b* are formed by bending the piece of conductive material along lines 116, 122, 130, and 138 (as indicated by arrows 114, 124, 132, and 140). Thus, shielding device 10 may be formed from a single cut piece of material by bending the material in designated locations.

While implementations of the shielding device 10 have been described above, in general, the shielding device 10 having exemplary dimensions can be customized for an inductor based on the dimensions of the inductor. In addition, the shielding device 10 can be used for both single gap and dual gap inductors.

Figure 7A:
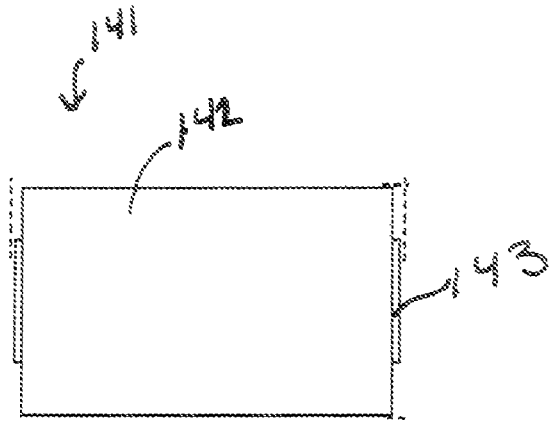
FIG. 7A is a top view of an inductor.
Figure 7B:
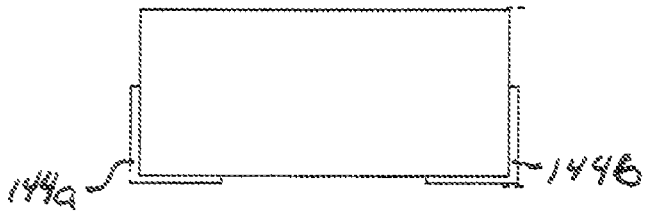
FIG. 7B is a side view of the inductor of FIG. 2A.
Figure 7C:
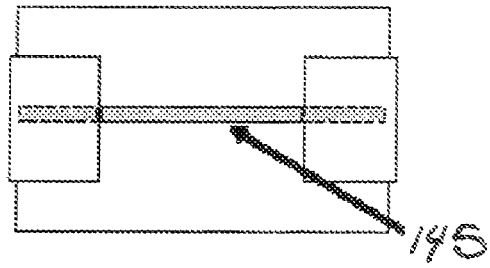
FIG. 7C is a bottom view of the inductor of FIG. 2A.

For example, FIGS. 7A-7C show a single gap inductor 141. In general, the single gap inductor 141 can be constructed as a lead wire 143 with a core 142 wrapped around the wire 143. The core 142 includes a slot through which the lead wire 142 extends. Portions 144*a* and 144*b* of the lead wire 142 extend outside the core 142 to form portions which are used to form an electrical contact with contact pads 22 and 26 (FIG. 1). The core 142 includes a gap 145. The gap 145 provides the inductance effect for inductor 141. In this example, the gap 145 is located on the bottom side of the inductor 141 and extends through the core 142 to the slot through which the lead wire 143 extends.

If an inductor having a single gap is used, a lengthwise portion of the inductor can be surrounded by the shielding device 10 and the conductive surface 24 of the printed circuit board 20 such that the stray magnetic field from the inductor is substantially shielded. The inductor 141 can be oriented within the shielding device as desired. For example, the inductor 141 can be oriented such that the gap 145 of the inductor 141 is located on a portion of the inductor located adjacent to the printed circuit board 20. In general, it is believed that the length of the gap of the inductor is proportional to the strength of the magnetic field generated by the inductor 141.

Figure 7D:
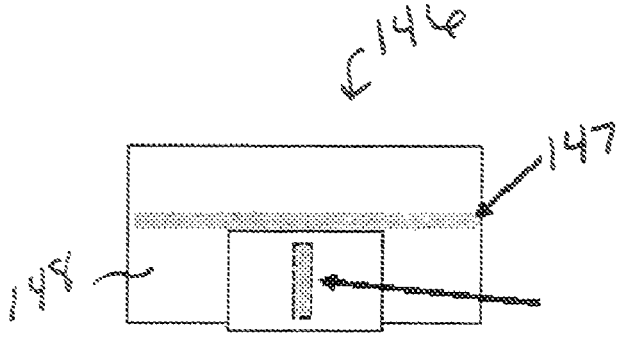
FIG. 7D is an edge view of an inductor.
Figure 13:
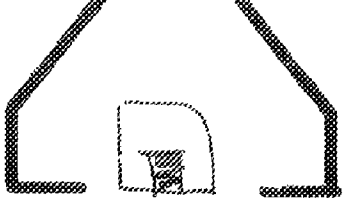
Figure 12:
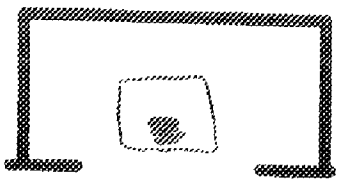
Figure 15:
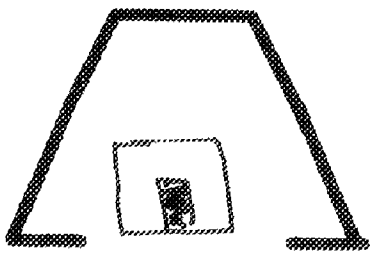
Figure 14:
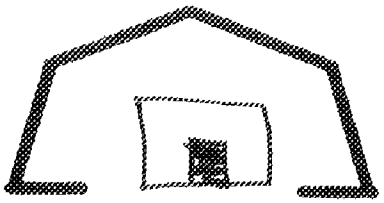
Figure 16:
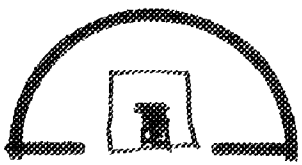

In order to reduce the stray magnetic field, in some implementations, it can be beneficial to use an inductor having two gaps. FIG. 7D shows another example of a dual-gap inductor 146 that includes a core 148 and a lead wire. In this exemplary inductor, the core 148 is formed of two components that are attached. The locations at which the components are attached form the gaps. The inductor 146 having two gaps can be oriented within the shielding device as desired. For example, the inductor can be oriented such that the portion of the inductor between the two gaps is located adjacent to the printed circuit board.

While implementations of the shielding device have been described above in which the shielding device is formed of three sides connected to form a substantially U-shaped shielding structure, other substantially U-shaped arrangements are possible.

FIG. 8 shows a cross-sectional view of a implementation of a shielding device 150 in which the shielding device 150 includes sides 154, 156, 158, 160, and 162 that form a substantially U-shaped shield configured to enclose a lengthwise portion of an inductor 12. As in the implementations described above, when attached to a conductive surface 24 on a printed circuit board 20 (e.g., using attachment portions 152 and 164), shielding device 150 and the conductive surface 24 substantially surround a lengthwise portion of the inductor 12.

FIG. 9 shows a cross-sectional view of an implementation of a shielding device 170 in which the shielding device 170 includes sides 174, 176, 178, and 180 that form a substantially U-shaped shield configured to enclose a lengthwise portion of an inductor 12. As in the implementations described above, when attached to a conductive surface 24 on a printed circuit board 20 (e.g., using attachment portions 172 and 182), shielding device 170 and the conductive surface 24 substantially surround a lengthwise portion of the inductor 12.

FIG. 10 shows a cross-sectional view of an implementation of a shielding device 190 in which the shielding device 190 includes sides 194, 196 and 197 that form a substantially U-shaped shield configured to enclose a lengthwise portion of an inductor 12. As in the implementations described above, when attached to a conductive surface 24 on a printed circuit board 20 (e.g., using attachment portions 192 and 198), shielding device 190 and the conductive surface 24 substantially surround a lengthwise portion of the inductor 12.

FIG. 11 shows a cross-sectional view of an implementation of a shielding device 200 in which the shielding device 150 includes a single curved portion 204 that forms a substantially U-shaped shield configured to enclose a lengthwise portion of an inductor 12. As in the implementations described above, when attached to a conductive surface 24 on a printed circuit board 20 (e.g., using attachment portions 202 and 206), shielding device 200 and the conductive surface 24 substantially surround a lengthwise portion of the inductor 12.

As shown in FIGS. 12-16, in some implementations, the attachment portions can extend inward toward the center of the shielding device.

While implementations of the shielding device 10 have been described as shielding an inductor, shielding device 10 can be used to shield other types of devices. For example, shielding device 10 can be used to shield a transformer. In implementations where the shielding device 10 shield s a transformer, the shielding device 10 can be customized for the transformer based on the dimensions of the transformer.

Elements of different implementations described herein may be combined to form other implementations not specifically set forth above. Other implementations not specifically described herein are also within the scope of the following claims.

What is claimed is:

1. A method comprising:

attaching an inductor to a printed circuit board having a conductive pad, the inductor comprising a core component; and attaching a U-shaped conductive shielding component to the conductive pad on the printed circuit board such that:

the conductive pad and the U-shaped conductive shielding component substantially surround a lengthwise portion of the inductor; and the U-shaped conductive shielding component at least partially covers the inductor and the core component.

2. The method of claim 1, wherein attaching the inductor to the conductive pad on the printed circuit board comprises attaching the inductor such that a gap of the inductor is located on a portion of the inductor located adjacent to the printed circuit board.

3. The method of claim 1, wherein the U-shaped conductive shielding component comprises:

a first side substantially perpendicular to the printed circuit board;

a second side substantially perpendicular to the printed circuit board and substantially parallel to the first side; and a third side connected to the first and second sides and substantially parallel to the printed circuit board.

4. The method of claim 1, further comprising forming the U-shaped conductive shielding component using a metal stamping process.

5. The method of claim 1, wherein attaching the U-shaped conductive shielding component to the conductive pad on the printed circuit board comprises soldering the U-shaped conductive shielding component to the conductive pad on the printed circuit board.

6. A system for reducing stray magnetic fields from an inductor, the system comprising:

a printed circuit board having a conductive pad;

a core component of the inductor, with the core component configured to attach to the conductive pad; and a conductive shielding device configured to at least partially cover the core component when attached to the conductive pad, the conductive shielding device comprising:

a first side;

a second side substantially parallel to the first side; and a third side attached between the first and the second sides, the third side being substantially perpendicular to the first and the second sides.

7. The system of claim 6, wherein:

the first side of the conductive shielding device is substantially perpendicular to a surface of the printed circuit board;

the second side of the conductive shielding device is substantially perpendicular to the surface of the printed circuit board; and the third side of the conductive shielding device is substantially parallel to the surface of the printed circuit board.

8. The system of claim 6, wherein the conductive pad is on a surface of the printed circuit board.

9. The system of claim 6, wherein the conductive shielding device further comprises:

a first attachment portion extending at an angle from the first side; and a second attachment portion extending at an angle from the second side.

10. The system of claim 9, wherein the first attachment portion and the second attachment portion are configured for electrical communication with the conductive pad.

11. The system of claim 6, wherein the conductive shielding device comprises a stamped metal component.

12. The system of claim 6, wherein the conductive shielding device comprises copper.

13. The system of claim 6, wherein the conductive shielding device comprises tin.

14. The system of claim 6, wherein the core component attaches the inductor to the printed circuit board.

15. The system of claim 6, wherein the conductive pad, the first side of the conductive shielding device, the second side of the conductive shielding device, and the third side of the conductive shielding device substantially surround a lengthwise portion of the inductor.

16. A device for reducing stray magnetic fields from an inductor, the device comprising:

a substantially U-shaped stamped metal component configured to (i) attach to a conductive surface of a printed circuit board, (ii) substantially surround a lengthwise portion of the inductor on three sides of the inductor, and (iii) at least partially cover a core component of the inductor when the core component is attached to the conductive surface of the printed circuit board.

* * * * *